US006978980B2

(12) United States Patent
Plattner et al.

(10) Patent No.: US 6,978,980 B2
(45) Date of Patent: Dec. 27, 2005

(54) SLIDE VALVE CLOSURE FOR THE CASTING OF A METAL MELT AND A REFRACTORY PLATE UNIT BELONGING TO IT

(75) Inventors: Werner Plattner, Hünenberg (CH); Harry Amsler, Greppen (CH); Wolfgang Müller, Bamberg (DE); Ralf Bock, Bonn (DE)

(73) Assignees: Hydro Aluminum Deutschland GmbH, Cologne (DE); Stopinc AG, Hunenberg (CH)

( * ) Notice: Subject to any disclaimer, the term of this patent is extended or adjusted under 35 U.S.C. 154(b) by 148 days.

(21) Appl. No.: 10/312,801

(22) PCT Filed: Jul. 7, 2001

(86) PCT No.: PCT/EP01/07822

§ 371 (c)(1),
(2), (4) Date: Jun. 9, 2003

(87) PCT Pub. No.: WO02/04148

PCT Pub. Date: Jan. 17, 2002

(65) Prior Publication Data

US 2004/0026467 A1 Feb. 12, 2004

(30) Foreign Application Priority Data

Jul. 12, 2000 (DE) ..... 100 33 904

(51) Int. Cl.[7] ..... F16K 25/00
(52) U.S. Cl. ..... 251/176; 251/193; 251/327; 222/599

(58) Field of Search ..... 251/176, 193, 251/326, 327; 222/597, 598, 599, 600

(56) References Cited

U.S. PATENT DOCUMENTS

| | | | | |
|---|---|---|---|---|
| 3,435,884 A | | 4/1969 | Orris et al. | |
| 3,627,018 A | | 12/1971 | Costello et al. | |
| 3,905,419 A | | 9/1975 | Tenner | |
| 4,063,668 A | * | 12/1977 | Shapland et al. | 222/512 |
| 4,273,315 A | * | 6/1981 | Tinnes | 266/236 |
| 5,350,159 A | * | 9/1994 | Parker | 266/237 |
| 5,400,930 A | | 3/1995 | Richard | |
| 5,518,154 A | * | 5/1996 | Vassilicos et al. | 222/600 |

FOREIGN PATENT DOCUMENTS

| | | |
|---|---|---|
| DE | 26 46 187 | 4/1978 |
| DE | 33 22 542 | 1/1985 |
| HU | 216003 B | 4/1999 |
| WO | WO 00/06325 | 2/2000 |

* cited by examiner

*Primary Examiner*—Edward K. Look
*Assistant Examiner*—John K. Fristoe, Jr.
(74) *Attorney, Agent, or Firm*—Proskauer Rose LLP

(57) ABSTRACT

In a slide valve closure for the casting of a metal melt a slider plate and a stationary closure part are braced against each other by means of spring units or by other means. There is provided a casing framework attachable to a mould or the like, in which is fixed a detachable casing part on which the spring units are held and in which the stationary closure part and the slider plate can be accommodated. This allows safe operation and simple and rapid mounting and dismounting of the slide valve closure.

13 Claims, 3 Drawing Sheets

SLIDE VALVE CLOSURE FOR THE CASTING OF A METAL MELT AND A REFRACTORY PLATE UNIT BELONGING TO IT

BACKGROUND OF THE INVENTION

The invention relates to a slide valve closure for the casting of a metal melt, having at least one stationary closure part on a mould or the like, and having a slider plate moveable with respect to this, and a refractory plate unit belonging to it.

In a known slide valve closure for a pressure die casting apparatus according to CH-A-415 972, the riser pipe of a casting furnace is provided at the upper end with a cover plate which seals the casting furnace. On this cover plate there is arranged a slide valve closure with a stationary plate, thereover a slider plate and a block section positioned above the slider plate, on which the mould can be placed.

In another slide valve closure according to DE-A-12 93 962, said closure is mounted on the underside of the mould. The slide valve closure in this case is made up of a lower closing section, the slider plate and a stationary plate located above the slider plate.

These known slide valve closures have the fundamental disadvantage that sealing is not ensured between the slider plate and the part located therebelow or thereabove, with which said slider plate is in sliding contact respectively during opening or closing. As a result, metal melt which usually has a low viscosity can very easily flow between these. Melt pulled in between these plates generally solidifies rapidly which can lead to a blockage of the slider plate after just a few displacement movements.

SUMMARY OF THE INVENTION

In contrast, it was the object of the present invention to provide a slide valve closure which is configured such that reliable and economic operation of a pressure-die casting apparatus or the like is achieved with this in total and in this case, its slider plate or closure parts should have long durability.

The object is achieved according to the invention by the slider plate and the at least one stationary closure part being braced towards one another by means of spring units or by other means.

With this slider valve closure according to the invention, optimum conditions have been provided for economic use of a slider valve closure in such a pressure die casting apparatus or the like. The slider plate and the closure parts can in this case be used for up to several hundred processes of pouring the melt into the mould or the like without changing.

In a very advantageous embodiment, there is provided a casing framework attachable to the mould or the like in which is fixed a detachable casing part on which the spring units are held and the stationary closure part and the slider plate can be accommodated. With this removability of the casing part from the casing framework, the closure can be dismantled or mounted on the mould very simply and quickly.

For the longest possible service life the refractory slider plate and the at least one closure part have graphite, Al titanate or zirconium as their main constituent.

BRIEF DESCRIPTION OF THE DRAWINGS

Embodiments and further advantages of the invention are explained in detail with reference to the drawings wherein.

DETAILED DESCRIPTION OF THE INVENTION

Figure 1:
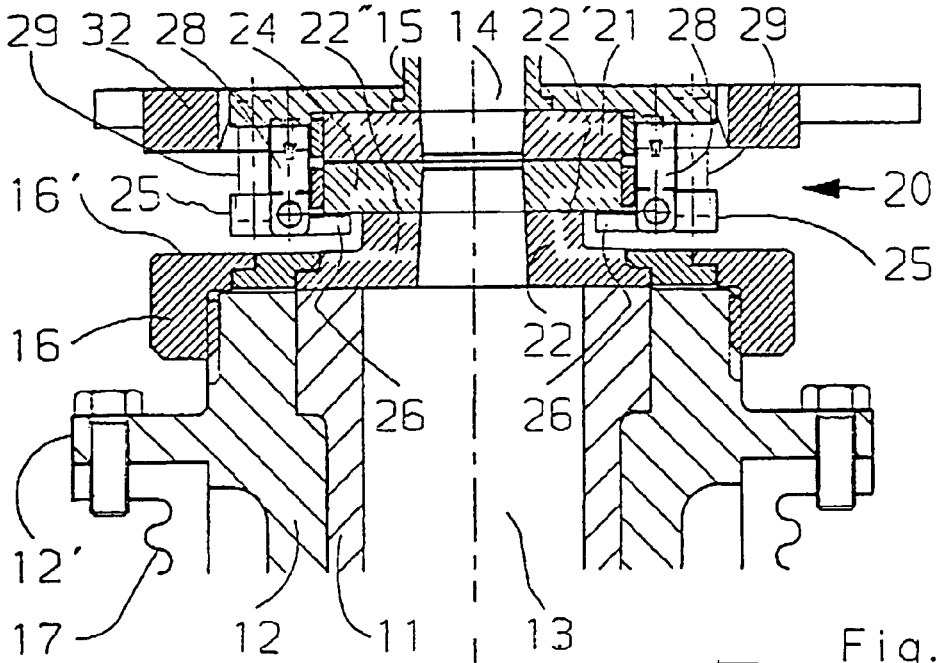
FIG. 1 shows a cross-section of a slide valve closure of a pressure die casting apparatus, shown in part, according to the invention.
Figure 2:
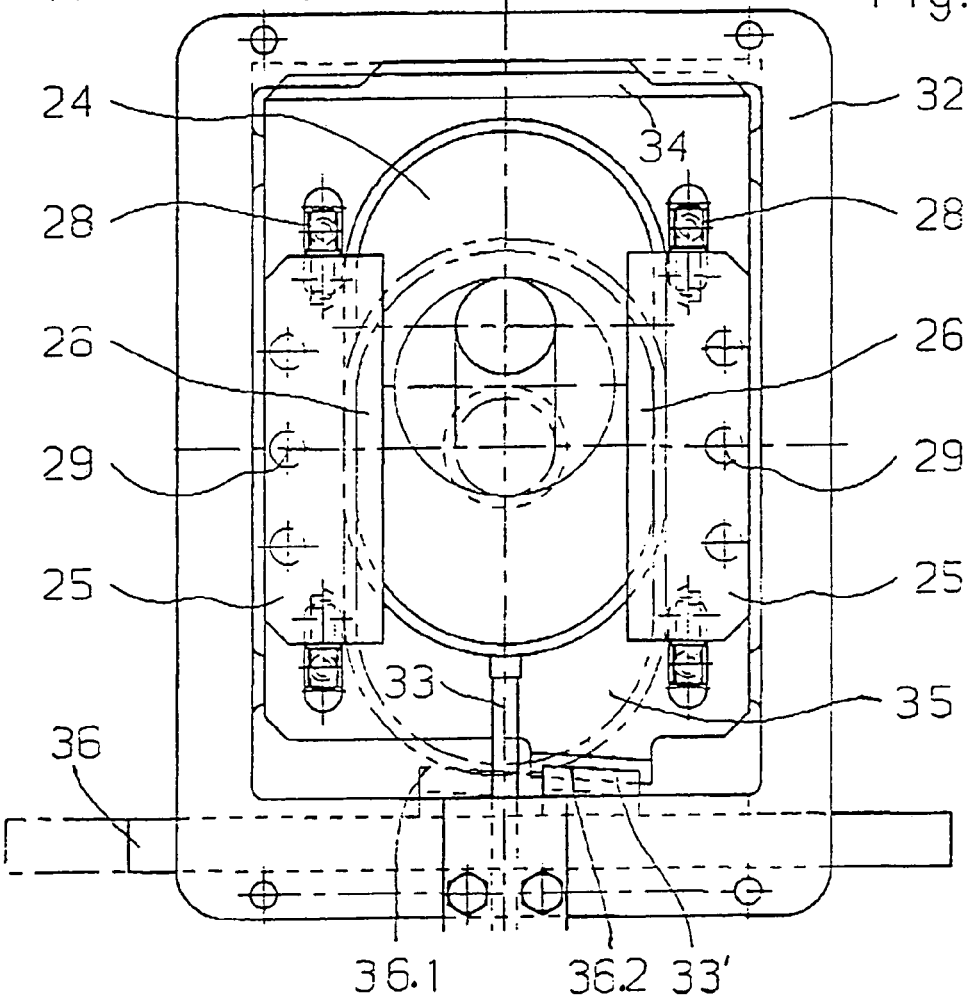
FIG. 2 is a top view of the slide valve closure according to FIG. 1.
Figure 3:
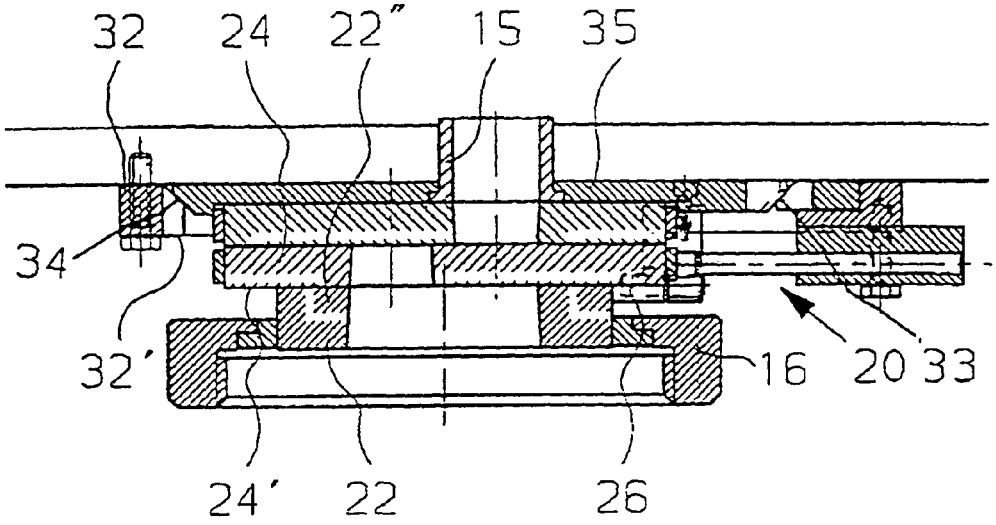
FIG. 3 is a longitudinal section of the slide valve closure according to FIG. 1.

FIGS. 1 to 3 show a slide valve closure 20 which serves to open and close a through opening 13, 14. The slide valve closure 20 has an upper and a lower stationary closure part 21, 22 and slider plate 24 moveable between them, wherein these parts coming in contact with the melt are made of a refractory material.

Suggestively, of a pressure die casting apparatus which is preferably used for uphill casting of a light metal alloy, it is possible to see the upper end of the riser pipe 11, 12 from a casting furnace, through which the melt is brought upwards into a mould 15 shown in a rudimentary fashion, for which one through opening 13, 14 each is provided, wherein between the riser pipe 11, 12 and the mould 15 there is arranged the slide valve closure 20 with the closure part 21 and the slider plate 24.

According to the invention, the slider plate 24 can be pressed by means of spring units 25 against the upper stationary closure part 21 or by other means against the lower closure part 22. The upper closure part 21 and the slider plate 24 sliding below it are pressed one against the other by the spring units 25 and assigned to the mould 15, whereas the lower closure part 22 is assigned to the riser pipe 11, 12. When the mould 15 is placed on the casting furnace, the slider plate 24 is pressed tightly against the upper slide surface 22' of the closure part 22 wherein the means for this pressing can be provided by the own weight of the mould 15 and/or an additional bracing means not shown in detail. This bracing means can, for example, be a docking mechanism by which means the mould is positioned on the furnace and clamped tightly.

The lower closure part 22 has a collar 22" projecting towards the upper side 16' of the riser pipe, which has such a height and width that the spring units 25 can grip the slider plate 24 on both sides from below with rocker arms 26. In principle, also the slider plate 24 could have a corresponding collar on its underside.

In a very advantageous embodiment in the framework of the invention, there is provided a casing framework 32 attachable to the mould 15 or the like, in which is fixed a detachable casing part 35 on which the spring units 25 are held and the stationary closure part 21 and the slider plate 24 can be accommodated.

The casing framework 32 and the casing part 35 detachable therein have guide surfaces 33, 34 corresponding to one another on both sides, wherein the one guide surface of the casing framework 32 is held approximately displaceably in its longitudinal extension such that the casing part 35 can be braced therein or detached therefrom. For this surface the guide surface 33 of the casing framework 32 is formed by a wedge 33' projecting on a guide rod 36. This guide rod 36 is held longitudinally displaceably in the casing framework 32 and can be pushed from outside the framework 32 into a position 36.2 bracing the casing part 35, as shown, or into a detached position 36.1 in which the casing part 35 can be removed from the framework 32 especially for changing the plates 21, 24, while the framework 32 remains on the mould or the like. The guide surfaces 33 of the wedge 33' and of the casing part 35 are arranged at an angle of a few degrees with respect to the direction of displacement of the wedge 33' such that a non-detaching wedge bracing is formed in the position 36.2.

On the opposite side the guide surfaces 34 as seen parallel to the direction of displacement of the guide rod 36 and in cross-section, are provided with a slope so that the casing part 35 can be quasi-suspended in the framework 32 and is then fixed therein by displacement of the wedge 33'.

The riser pipe has a refractory casting pipe 11 and a metal pipe 12 holding this, having an upper flange 12' which is secured to a bellows 17. This bellows 17 advantageously made of sheet metal is provided with such a rigidity that a restricted floating mounting is formed with the lower closure part 22, so that whole-area contact is ensured when the slider plate 24 presses against this closure part 22 and thus an optimum seal between the two is assured. On the underside the closure part 22 also abuts tightly against a refractory casting pipe 11 held in the metal pipe 12 which projects with its lower end into the melt.

As can also be seen from FIG. 2, the spring units 25 each have a rocker arm 26 on both sides-of the plate 24, which are each flexibly mounted on straps 28 and are acted upon by spring elements 29 on the side facing away from the plate 24 such that the front ends of the rocker arms 26 press the slider plate upwards against the closure part 21 which is held in a casing framework 32. The casing framework 32 is for its part attached to the underside of the mould 15. Also shown is a drive rod 33, coupled at the front to the slider plate, which belongs to a drive unit not shown in detail.

This pressure die casting apparatus is distinguished by the fact that the moulds to be successively filled with melt can be positioned simply and quickly on the casting furnace, filled and replaced by a next mould.

According to FIG. 3, the casing framework 32 with its underside 32' on the side facing away from the drive unit is preferably arranged above the lower sliding surface 24' of the slider plate 24. By this means the mould 15 together with the slide valve closure 20 attached to its underside can be moved forward in the longitudinal direction of the slider plate 24 in such a fashion that the collar 22" of the closure part 22 belonging to the casting furnace comes to lie between the rocker arms 26 and the mould 15 can be lowered onto this closure part 22 after reaching the casting position.

Figure 4:
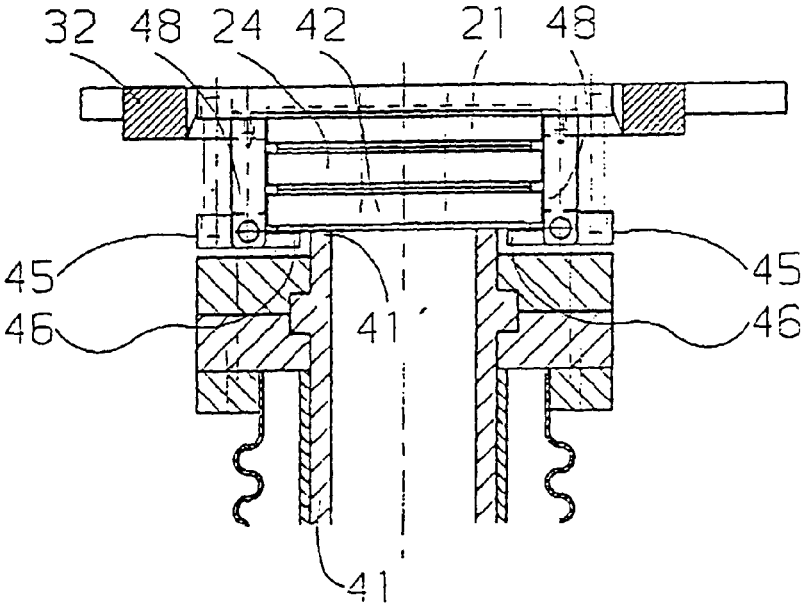
FIG. 4 is a part cross-section of a slide valve closure.

FIG. 4 shows a variant of a pressure die casting apparatus which is constructed in inherently the same fashion as in FIG. 1 so that reference is made to the above explanations. The only difference is that the lower stationary closure part 42 is assigned not to the riser pipe 41 but to the mould. Accordingly, the upper and lower closure part 21, 42 as well as the slider plate 24 are braced with respect to one another by rocker arms 46 of the spring units 45 in the casing framework 32. As the mould is moved forward, this lower closure part 42 comes to lie on the projecting collar 41' of the riser pipe 41. This offers the advantage that no displacement takes place between the two and that between the slider plate 24 and the upper or lower closure part 21, 42 there is a defined bracing force.

Figure 5:
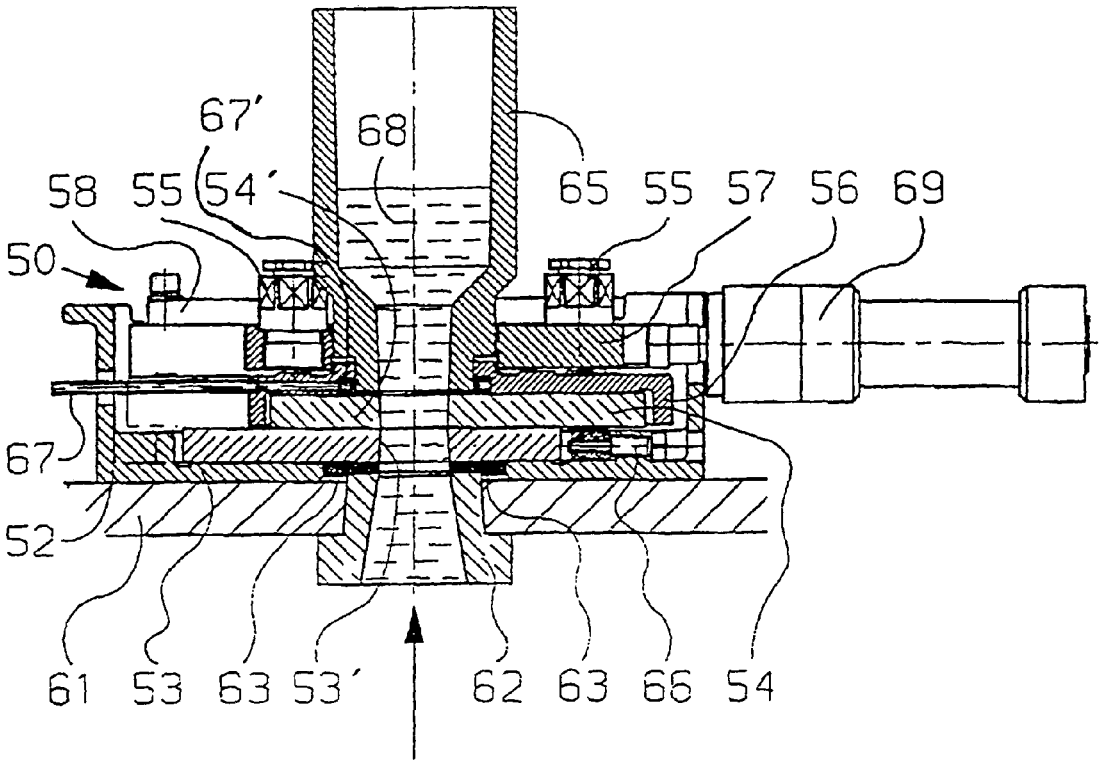
FIG. 5 is a longitudinal section of a further variant of a slide valve closure.

FIG. 5 shows a slide valve closure 50 which, unlike that shown in FIG. 1, is not attached to the mould 65 but to an rudimentary shown casting furnace 61. The mould 65 shown simplified is accordingly attached to the slide valve closure 50 which remains on the mould and detached again.

More suitably the slide valve closure 50 has a casing framework 52 attached to the casting furnace 61 in which is fixed a lower stationary refractory closure part 63 at the front using a tightening screw 66 or the like. The slider plate 54 arranged slidably above the closure part 63 is held in a slider framework 56 which for its part is driven along by a slider 57 adjustable by a drive unit 69. This slider 57 is guided on slide rails 58 which are attached at the top to the casing frame 52. Between the slider plate 54 and the mould 65 and also between the closure part 53 and the riser pipe 62 there are further provided seals 63, 64.

According to the invention spring units 55 are arranged between the mould 65 and the casting furnace 61, these being presently integrated in the slider 57 and bringing about bracing of the slider plate 54 with the closure part 53. With this arrangement, several hundred fillings of the moulds can be carried out without the need to change the slider plate 54 or the closure part 53.

Also rudimentary shown is the melt 68 during the filling process. As soon as the mould 65 is full, this is pushed by the controlled drive unit 69 together with the slider plate 54 into the closure position. A feed line 67 for a coolant above the slider plate 54 into an annular groove 67' surrounding the mouth opening of the mould 65 allows accelerated cooling and thus rapid solidification of the melt 68 so that the mould can be removed from the slide valve closure 50 and a new empty mould can be placed on the slider plate.

The slider plate 54 or the closure part 53 adjacent thereto, which form the closing surface, are each provided with through openings 53', 54' such that they are expanded in diameter upwards or downwards starting from the closing surface. Thus, the melt solidified in the through opening 54' of the slider plate 54 can be removed without any problem during removal of the mould 65.

As a further contribution to the economic efficiency of the pressure die casting apparatus according to the invention, there is provided a refractory plate unit consisting of at least one stationary closure part 21, 22, 42, 53 and a slider plate 24, 54, for which the following material combinations are used during manufacture:

For the slider plate 24, 54 graphite is used as the main constituent and for the at least one stationary closure part 21, 22, 42, 53 graphite, Al titanate or zirconium is used as the main constituent. Naturally, this can also be provided in the inverse sense, i.e., graphite is used for the closure part and graphite, Al titanate or zirconium is used for the slider plate.

The invention is shown adequately using the embodiments described above. The design of the casting furnace with the riser pipe can naturally differ from that shown. In principle, the riser pipe itself could form an upper plane front surface and thus the closure part on which the slider plate would be slidably arranged.

What is claimed is:

1. A slide valve closure in a pressure die casting apparatus for the high pressure casting of a metal melt, comprising:

at least one stationary closure part configured to be attached to and form a tight seal with a mould of the pressure die casting apparatus, a slider plate movable with respect to the stationary closure part, said slider plate configured to be attached to and form a tight seal with a riser pipe of a casting furnace of the pressure die casting apparatus, spring units which brace the stationary closure part and the slider plate towards each other to form a tight seal therebetween, wherein in a fully mounted state of the pressure die casting apparatus wherein the mould is attached to the riser pipe with the slide valve closure therebetween, the spring units are arranged at the slide valve closure between the mould and the riser pipe of the casting furnace, thereby forming tight seals between the mould and the riser pipe suitable for pressure die casting.

2. The slide valve closure of claim 1 further comprising a casing frame configured to be attached to the mould, the casing frame having a detachable casing part on which the spring units are held, the detachable casing part being configured for accommodating the stationary closure part and the slider plate.

3. The slide valve closure of claim 2 wherein the casing frame and the detachable casing part have corresponding guide surfaces, wherein the guide surface of the casing frame is held approximately displaceably in a longitudinal extension of the casing frame such that the detachable casing part can be braced therein or detached therefrom.

4. The slide valve closure of claim 3 wherein the guide surface of the casing frame is formed on a wedge of the casing frame projecting at a guide rod, wherein the guide rod and the wedge are longitudinally displaceable into a position bracing the detachable casing part in the casing frame, or into a position detaching the detachable casing part from the casing frame.

5. The slide valve closure of claim 1 wherein the stationary closure part has a projecting collar projecting towards the upper side of the casting furnace, and wherein the spring units include rocker arms which grip the slider plate on both sides from below.

6. The slide valve closure of claim 1 wherein the casing frame has an underside which is arranged above a lower sliding surface of the slider plate.

7. The slide valve closure of claim 1 wherein the stationary closure part comprises upper and lower closure parts, and wherein the spring units brace the upper and lower closure parts and the slider plate against one another within a casing frame configured to be attached to the mould.

8. The slide valve closure of claim 1 further comprising a casing framework attached to the casting furnace which supports a lower stationary closure part, a slider framework which supports the slider plate arranged slidably above the lower stationary closure part, and a slider which moves the slider framework, the spring units being integrated into the slider and bracing the slider plate against the lower stationary closure part to form a tight seal therebetween.

9. The slide valve closure of claim 1 further comprising a feed line which feeds a coolant into an annular groove connected thereto which surrounds an opening of the mould which are arranged above the slider plate.

10. The slide valve closure of claim 1 wherein the slider plate and the closure part are made from graphite, Al titanate, or zirconium as the main constituent.

11. The slide valve closure of claim 10 wherein one or both of the slider plate and the closure part adjacent thereto are provided with through openings which expand in diameter upwards or downwards.

12. The slide valve closure of claim 10 wherein the slider plate is made from graphite as its main constituent, and the stationary closure part is made from graphite, Al titanate, or zircomium as the main constituent.

13. The slide valve closure of claim 10 wherein the slider plate is made from graphite, Al titanate, or zirconium as the main constituent, and the closure part is made from graphite as its main constituent.

* * * * *